US007306077B2

(12) United States Patent
Heyden et al.

(10) Patent No.: US 7,306,077 B2
(45) Date of Patent: Dec. 11, 2007

(54) FAIL-SAFE, WEIGHT-RESPONSIVE SKATE RETARDER

(75) Inventors: Thomas J. Heyden, Arlington Heights, IL (US); Mark Zawlocki, Menomonee Falls, WI (US)

(73) Assignee: AAA Sales + Engineering, Inc., Oak Creek, WI (US)

( * ) Notice: Subject to any disclaimer, the term of this patent is extended or adjusted under 35 U.S.C. 154(b) by 250 days.

(21) Appl. No.: 11/134,592

(22) Filed: May 19, 2005

(65) Prior Publication Data

US 2006/0260883 A1 Nov. 23, 2006

(51) Int. Cl.
*B61K 7/04* (2006.01)

(52) U.S. Cl. ..... 188/62

(58) Field of Classification Search ..... 188/62, 188/174, 176, 38, 40, 63, 180; 104/26.2
See application file for complete search history.

(56) References Cited

U.S. PATENT DOCUMENTS

| | | | | | |
|---|---|---|---|---|---|
| 1,635,989 | A | * | 7/1927 | Frolich | 188/62 |
| 1,728,562 | A | * | 9/1929 | Grondahl | 188/62 |
| 1,792,206 | A | * | 2/1931 | Wenzel | 188/62 |
| 1,801,990 | A | * | 4/1931 | Wenzel | 188/62 |
| 2,326,924 | A | | 8/1943 | Bone | |
| 3,196,985 | A | | 7/1965 | Rowe et al. | |
| 3,273,672 | A | * | 9/1966 | Creedle et al. | 188/62 |
| 3,339,682 | A | * | 9/1967 | Engle | 188/62 |
| 3,519,107 | A | * | 7/1970 | Bellinger | 188/62 |
| 3,557,910 | A | * | 1/1971 | Wilson | 188/62 |
| 3,809,188 | A | * | 5/1974 | Frank et al. | 188/62 |
| 3,946,973 | A | | 3/1976 | Budway et al. | 246/182 |
| 4,030,574 | A | | 6/1977 | Evans | 188/62 |
| 4,125,177 | A | | 11/1978 | Durraffourt | 188/62 |
| 4,198,909 | A | | 4/1980 | Plantureux | 104/26 |
| 4,513,843 | A | | 4/1985 | Danieli et al. | 188/62 |
| 4,535,872 | A | | 8/1985 | Bick et al. | 188/62 |
| 4,650,038 | A | | 3/1987 | Bick | 188/62 |
| 4,867,279 | A | | 9/1989 | Link et al. | 188/62 |
| RE33,207 | E | | 5/1990 | Brodeur et al. | 188/1.11 |

(Continued)

OTHER PUBLICATIONS

General Railway Signal Corporation, SASIB Railway GRS, Type F Series Hydraulic Car Retarders, Jun. 1997.

(Continued)

*Primary Examiner*—Thomas Williams
(74) *Attorney, Agent, or Firm*—Andrus, Sceales, Starke & Sawall, LLP

(57) ABSTRACT

The present invention relates to a fail-safe skate retarder that applies a braking force proportional to the weight of a rail car entering the retarder. Each segment of the retarder includes a lever mechanism with a pair of levers rotatably joined under the running rail. Each lever holds a braking rail for engaging a wheel of the car. The retarder is normally in a lower, fail-safe position with the brake rails closer together than the width of the wheel. When the car enters the retarder, the wheel forces the brake rails apart into a braking position, and the middle of the lever mechanism rises to lift the running rail and car. A hydraulic power unit and cylinder is activated to raise the middle of the lever mechanism even further to a release position so that the brake rails are spread apart more than the width of the wheel.

15 Claims, 12 Drawing Sheets

U.S. PATENT DOCUMENTS

| | | | | |
|---|---|---|---|---|
| 5,029,675 | A | 7/1991 | Zhukov et al. | 188/62 |
| 5,092,248 | A | 3/1992 | Parry | 104/26.2 |
| 5,333,707 | A | 8/1994 | Kaneda | 188/296 |
| 5,388,525 | A | 2/1995 | Bodkin | 104/26.2 |
| 5,575,218 | A | 11/1996 | Gutknecht | 104/249 |
| 5,676,337 | A | 10/1997 | Giras et al. | 246/182 |
| RE36,084 | E | 2/1999 | Gutknecht | 104/249 |
| 5,967,051 | A | 10/1999 | Ragsdale | 104/60 |
| 6,152,042 | A | 11/2000 | Barry et al. | 104/262 |
| 6,220,400 | B1 | 4/2001 | Kickbush | 188/62 |
| 6,829,998 | B1 | 12/2004 | Kickbush | 104/26.2 |

OTHER PUBLICATIONS

AAA Sales and Engineering, Inc., R-2 Service Manual 0907, Admitted prior art.

* cited by examiner

FAIL-SAFE, WEIGHT-RESPONSIVE SKATE RETARDER

BACKGROUND OF THE INVENTION

Retarders are widely used in railroad marshalling yards to control the speed of the cars as they are being directed to their desired track and location. Controlling car speed is important. Cars should not exceed specific speed limits. Doing so can result in expensive and dangerous derailments. Some cars may need to travel significantly further through the yard than others, and some cars may be significantly heavier than others. Yet, heavier cars can pick up more speed and require more braking force to slow or stop.

Weight-responsive retarders such as the Type F4 skate retarder provide an amount of braking power proportional to the weight of the rail car. Skate retarders prevent cars from leaving the yard, which protects passing trains and surrounding property and persons. Each segment of the retarder includes a pair of levers joined together under the running rail and extending from opposed sides of the running rail. The levers hold a pair of braking rails, one on each side of the running rail. A hydraulic lift is activated to raise the gauge-side lever so that the braking rails are closer together than the width of a car wheel. A car entering the retarder will force the brake rails apart with a force proportional to the weight of the car. This braking force is applied to the sides of the wheels and causes the car to stop. Spreading the brake rails apart causes the levers to rotate about their knuckle joint, and raises the running rail and car against the force of gravity. The heavier the car, the more force needed to lift the car, and the more braking force applied to its wheels.

A problem with conventional F4 weight-responsive skate retarders is that they are not fail-safe. Power must be supplied to the hydraulic unit of the retarder to produce the braking force needed to stop a railroad car. The hydraulic lift moves the brake rails to their operating position. When power is cut off, the brake rails return to an open position that allows cars to pass through the retarder unimpeded. Weather conditions such as lightning strikes or mechanical malfunctions can cause a loss of power to the retarder and lead to dangerous situations in which the skate retarder cannot be used to stop a moving car. Derailments or crashes can occur that result in significant damage to cars, equipment and cargo, expensive clean up and yard downtime, and serious injury or loss of life to railroad personnel.

Another problem with conventional F4 skate retarders is their "power on" time. Power must be supplied to the hydraulic power unit throughout the day to keep the retarder operating. This increases power consumption and wear and tear on component parts such as in the hydraulic system. Leaks of hydraulic fluid are more prevalent, and more frequent maintenance checks and repairs are needed to ensure proper operation of the retarder.

A still further problem with conventional F4 skate retarders is that they are not universal. A right-handed retarder is needed when the braking levers need to be placed on the right-hand rail of the track, and a left-handed retarder is needed when the brake levers need to be on the left-hand rail. These limitations arise due to track spacing and electrical power locations. The railroad tie saddle has a wear plate on only one side. This plate must be located between the lever mechanism and the tie on its downhill side to maintain the proper alignment of the levers and protect the railroad tie from damage. Right-handed and left-handed retarders are not interchangeable, which results in increased inventory and ordering problems.

A still further problem with conventional F4 weight-responsive skate retarders is the disproportionate movement of the levers and their brake rails. Because the hydraulic cylinder is placed at the outer end of the gauge-side lever, when the hydraulic cylinder is deactivated or lowered, the gauge-side lever moves to its release position that allows the rail cars to pass through the retarder unobstructed. When the hydraulic cylinder is lowered, the braking rail mounted to the gauge-side lever moves a lateral distance of about one inch. Yet, the braking rail mounted to the field-side lever remains substantially stationary, which can result in the wheels of a car dragging on the field-side brake rail when in its release position. This causes excessive wear of the field-side brake rail. A great deal of attention and effort is needed to ensure proper alignment between the running rails and the field-side lever brake rail to ensure proper clearance when the retarder is in its lowered release position to minimize potential engagement with the car wheels.

A problem with conventional (non-F4) skate retarders is that they do not apply consistent weight-responsive braking force to the car wheels. Either too much braking power is applied to unloaded or lighter weight cars (causing the cars to derail), or too little braking power is applied to fully loaded or heavier weight cars (failing to slow or stop the car as desired). Both situations can result in loss of life and significant property damage. Skate retarders that are not weight responsive have difficulty applying a proper amount of force to a passing car. A non-weight responsive skate retarder with a low enough brake force to leave a light car on the track needs to be very long in order to stop a heavy, fast moving car. Longer skate retarders tend to be more expensive and reduce the storage capacity of the yard, which reduces the overall efficiency of the yard.

A further problem with non-weight-responsive (non-F4) skate retarders is the need for regular and frequent maintenance to ensure proper spacing and shimming of the brake rails. Because the brake force produced by the retarder is provided by springs, wear of the brake or rails results in a loss of braking power.

A still further problem with conventional skate retarders is maintenance difficulty. Ballast gravel surrounding the retarder prevents easy access to components such as the hydraulic cylinder, and could even jam the lever arms.

The present invention is intended to solve these and other problems.

BRIEF DESCRIPTION OF THE INVENTION

The present invention relates to a fail-safe skate retarder that applies a braking force proportional to the weight of a rail car entering the retarder. Each segment of the retarder includes a lever mechanism with a pair of levers rotatably joined under the running rail. Each lever holds a braking rail for engaging a wheel of the car. The retarder is normally in a lower, fail-safe position with the brake rails closer together than the width of the wheel. When the car enters the retarder, the wheel forces the brake rails apart into a braking position, and the middle of the lever mechanism rises to lift the running rail and car. A hydraulic power unit and cylinder is activated to raise the middle of the lever mechanism even further to a release position so that the brake rails are spread apart more than the width of the wheel.

One advantage of the present weight-responsive skate retarders is its fail-safe design. Power does not need to be supplied to the retarder to produce braking force. If power is cut off, the levers and brake rails go to their brake ready position where the brake rails are spaced closer together than the width of a wheel. Cars passing through the retarder continue to receive the desired amount of braking force. Weather conditions such as lightning strikes and mechanical malfunctions such as a loss of hydraulic fluid do not affect the fail-safe operation of the retarder. Dangerous situations that can lead to costly damage to cars, equipment and cargo, yard delays, and serious injury or loss of life are avoided.

Another advantage of the present retarder is its minimal "power on" time. Power is only supplied to the hydraulic power unit and cylinder when the retarder is placed in its open or release position. Power consumption and wear and tear on component parts such as in the hydraulic system are kept to a minimum. Leaks in hydraulic fluid are reduced, and maintenance checks and repairs are needed less frequently.

A further advantage of the present skate retarder is its modular design. The length of the retarder can be increased by adding additional like-shaped segments and appropriate sizing of the brake rails. Each segment includes an additional lever mechanism for gripping and releasing the wheels of a passing car. These lever mechanisms are also interchangeable. Thus, the retarder can be economically used in a wide range of yard applications. Due to the larger brake forces this retarder can apply, the retarder is suitable for yards with steeper gradients or heavier car load such as for coal cars.

A still further advantage of the present retarder is its ability to apply consistent weight-responsive braking force to the car wheels. The desired braking power is applied to unloaded or light weight cars and heavy or loaded cars so that they are stopped as intended. A consistent weight responsive brake force is applied even if the brake shoes or rails are worn and the retarder has not been shimmed recently. This prevents costly and dangerous derailments or crashes.

A still further advantage of the present skate retarder is its universal saddle. The same retarder assembly can be installed on either side of a track having a given downhill direction. The saddle should be placed on the railroad tie on the downhill side of the lever mechanism. Saddles with just one side saddle can only be used on one side of a track having a given downhill direction. This is because the anti-creep flange must be located on the field-side of the running rail to which the lever mechanism is installed. The universal saddle and its two side saddles allow it to be placed on either side of the track while keeping the anti-creep flange on the field-side of the running rail to which it is installed. This interchangeability permits installation flexibility, and reduces the inventory of saddles needed for repair and replacement purposes.

A still further advantage of the present weight responsive skate retarder is its ability to stop both light and heavy cars, as well as slow and fast moving cars, in a minimal distance. This allows the tracks to be used for car storage, not car deceleration. This is important because usable track length equals maximum train length. If a track becomes shorter, then two tracks may need to be combined to form a single train, which costs time and reduces yard efficiency.

A still further advantage of the present weight-responsive skate retarders is the proportional movement of its levers and brake rails. Each lever and brake rail moves laterally a substantially equal amount when the retarder moves from its lower fail-safe position to its raised release position. This equal lateral movement reduces installation and operating problems. The levers are more easily installed and maintained so that their brake rails are properly aligned and spaced to engage a car wheel when in the fail-safe position and are properly aligned and spaced to avoid engagement with the wheels when in the raised release position.

A still further advantage of the present skate retarder is its ease of maintenance. Ballast plates prevent gravel from covering the working components for easy access. The ballast plates can even prevent gravel or the like from jamming the lever arms. The braking rails and their gauging shims are also easily accessible and removable.

Other aspects and advantages of the invention will become apparent upon making reference to the specification, claims and drawings.

DESCRIPTION OF THE PREFERRED EMBODIMENTS

Figure 1:
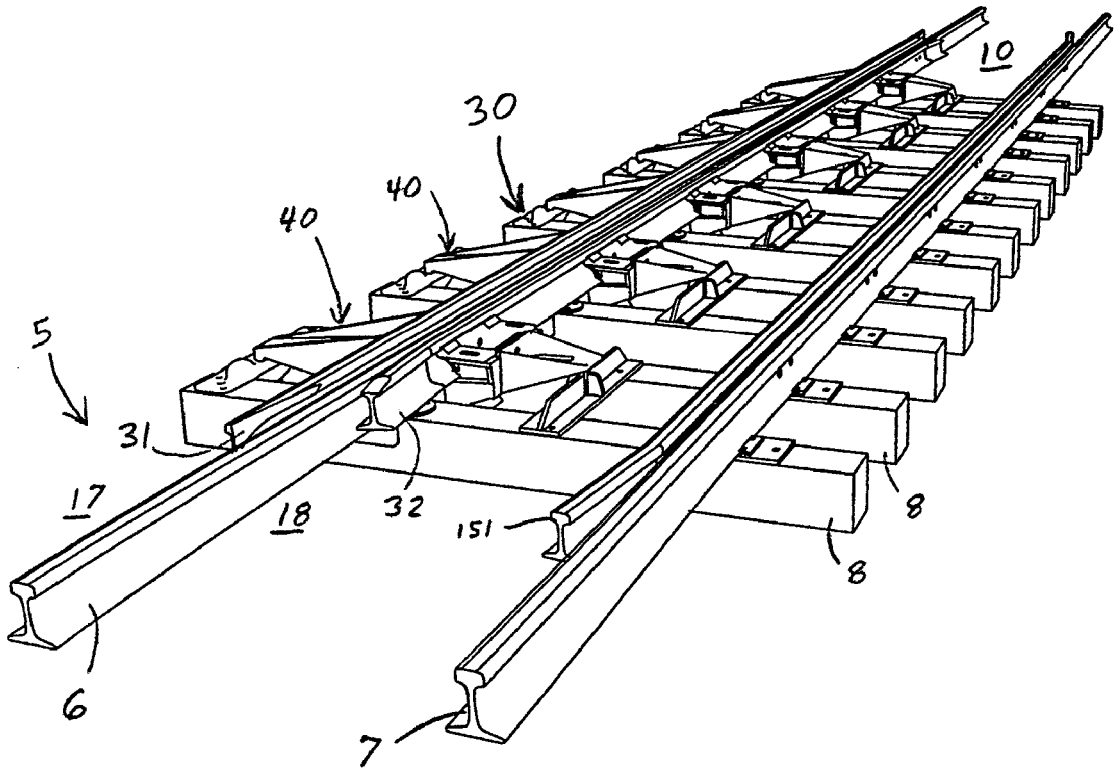
FIG. 1 is a perspective view of an embodiment of the present fail-safe weight-responsive skate retarder installed along a railroad track and including several lever mechanisms and a pair of continuous braking rails straddling a running rail.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Conventional railroad tracks 5 are formed by two uniformly spaced, generally parallel steel running rails 6 and 7 mounted atop a series of wooden railroad ties 8 supported by a bed of gravel ballast. Each rail 6 and 7 has a thicker upper head 12, a thinner middle web 13, and a thicker base 14 with a flat bottom surface. The flat base 14 typically rests on the flat upper surface of the ties 8 or a flat mounting plate on the upper surface of the tie. The rails 6 and 7 are held firmly in place at their base 14 by fasteners such as spikes driven into the ties. In switching or marshalling yard applications, the track 5 is sloped a slight amount so that railroad cars (not shown) tend to roll under their own weight by the force of gravity in a downhill direction 10 of the track. In a hump yard, the downhill direction 10 is the direction the cars travel when they roll down the hump. Each rail 6 and 7 has a field-side 17 that faces the yard or field, and a gauge-side 18 that faces the other rail.

The wheels 21 of railroad cars are supported by and roll along the running rails 6 and 7 of the track 5. Each wheel 21 has an outer load bearing surface 22 that directly engages the head 12 of the rail 6 or 7. Each wheel 21 has an inner radially extending rim 23 positioned along the gauge-side 18 of its rail 6 or 7, so that opposed wheels sharing a common axel remain aligned with and on the rails. The axle (not shown) spaces its opposed wheels 21 and their rims 23 a set distance apart so that the rims remain closely aligned with but do not bind up against the rails 6 and 7 as the car rolls down the track 5. Each wheel 21 has opposed side surfaces 27 and 28 that define the width of the wheel. Conventional railroad car wheels 21 have a predetermined width of about 5 23/32 (5.719) inches within a tolerance of about plus or minus 1/8 (0.125) inch.

Figure 2:
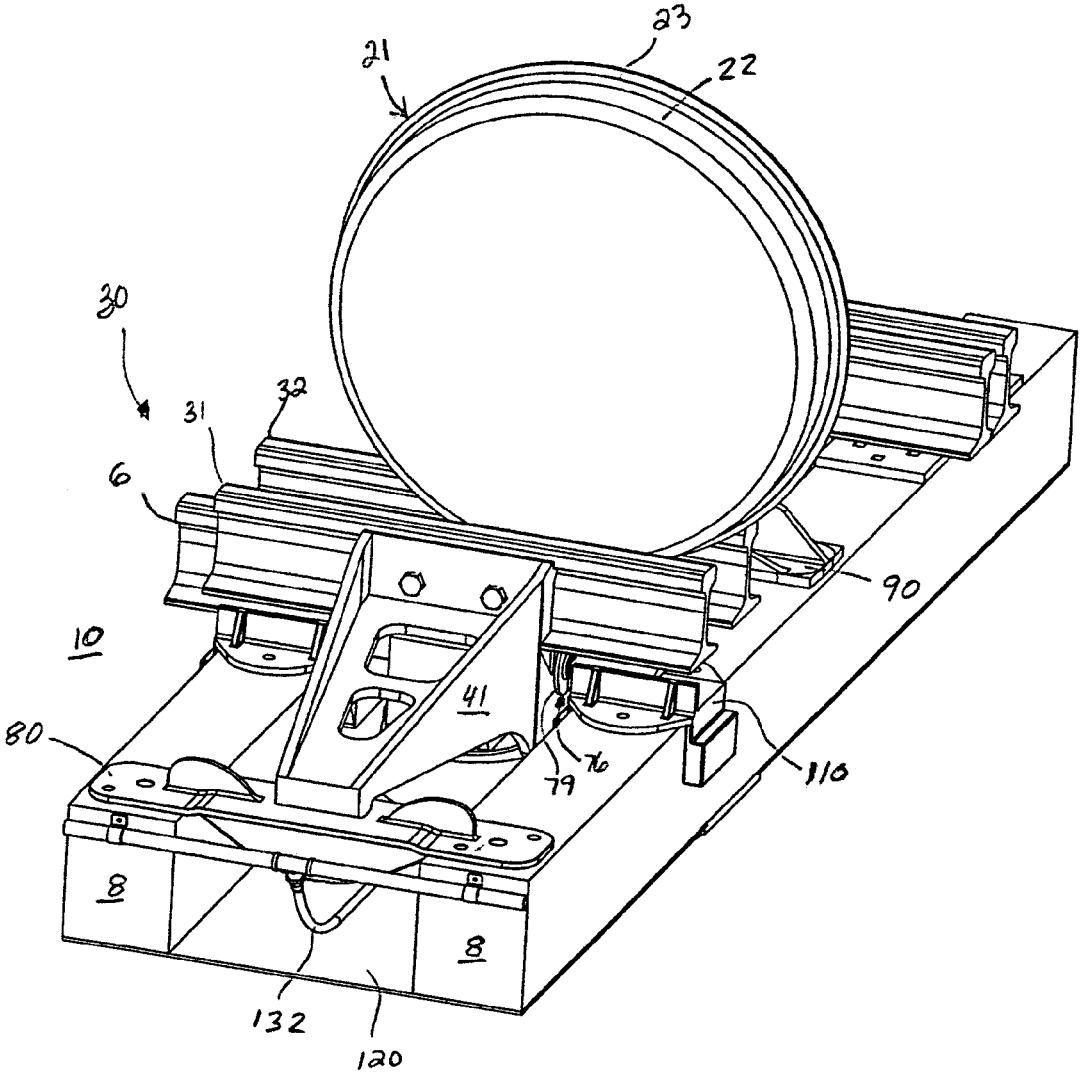
FIG. 2 is a perspective view showing a skate retarder lever mechanism in its braking position with its braking rails forcibly engaging the sides of a railroad car wheel, and the running rail raised off the railroad tie saddles.
Figure 3:
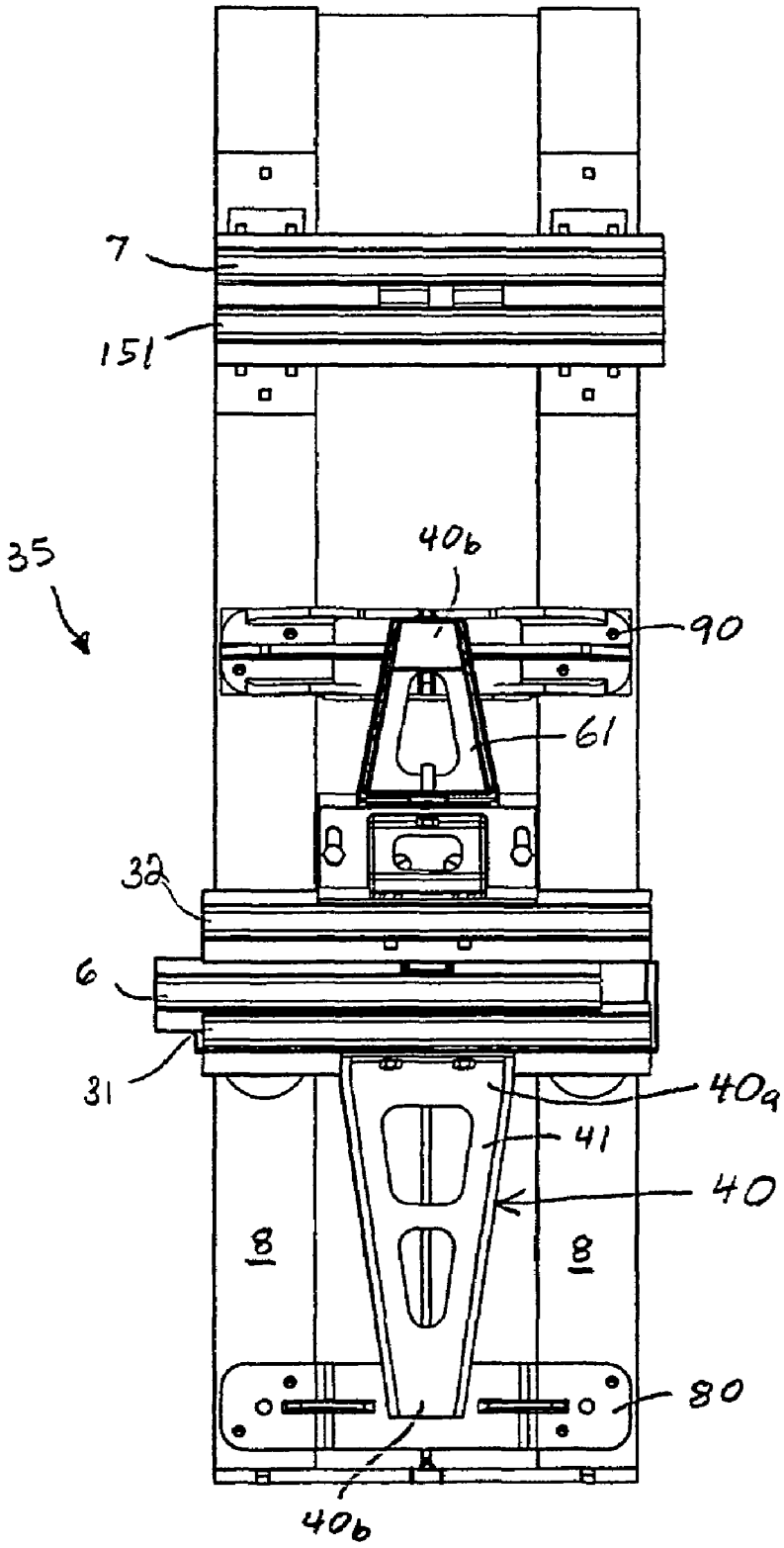
FIG. 3 is a top view of the skate retarder lever mechanism shown in FIG. 2.

The present invention relates to a fail-safe, weight-responsive skate retarder generally indicated by reference number 30 and shown in FIGS. 1-3. The skate retarder 30 includes a pair of cooperating brake rails 31 and 32 that straddle the running rail 6, and a number of evenly spaced lever mechanisms 40 located along a desired length of the track 5 for operably moving the braking rails into and out of braking engagement with the wheel 21. The brake rails 31 and 32 span the length of the retarder 30. The brake rails 31 and 32 have a similar construction to the running rails 6 and 7, except that their forward and trailing ends are flared or bowed to accommodate smooth receipt of the wheels 21 of the railroad cars. The head of each braking rail 31 and 32 has an inside surface 33 or 34 that selectively engages the sides 27 and 28 of the wheels 21 to apply a weight-responsive braking force. Each lever mechanism 40 has a middle portion **40*a* that extends under and firmly grips or is otherwise anchored to the base 14 of the running rail 6. Each lever mechanism 40 has opposed outer ends 40*b* that are pivotably supported by the ties 8**.

The retarder 30 has a modular construction with an overall length that meets specific yard or field requirements by adding or subtracting segments 35 to the retarder. Each segment 35 includes one lever mechanism 40 as in FIGS. 2 and 3. Each lever mechanism 40 has the same construction and is interchangeable with the other lever mechanisms. The component parts forming the lever mechanism assemblies 40 are like-shaped and interchangeable. The lever mechanism assembly 40 and its parts are made of steel and are robustly designed to withstand heavy loads and unfriendly weather and yard conditions. The overall length of the retarder 30 is easily adjusted by adding or subtracting one or more lever mechanisms 40, and increasing or decreasing the length of the braking rails 31 and 32 and the anti-derailment rail discussed below. Although the retarder 30 is shown and described as being used in conjunction with a track 5 having two running rails 6 and 7, it should be understood that the broad aspects of the invention apply to single rail tracks such as monorails or tracks with three or more running rails. In addition, although the retarder 30 is shown and described as being a skate retarder, it should be understood that the invention applies to a wide range of retarders.

Figure 4A:
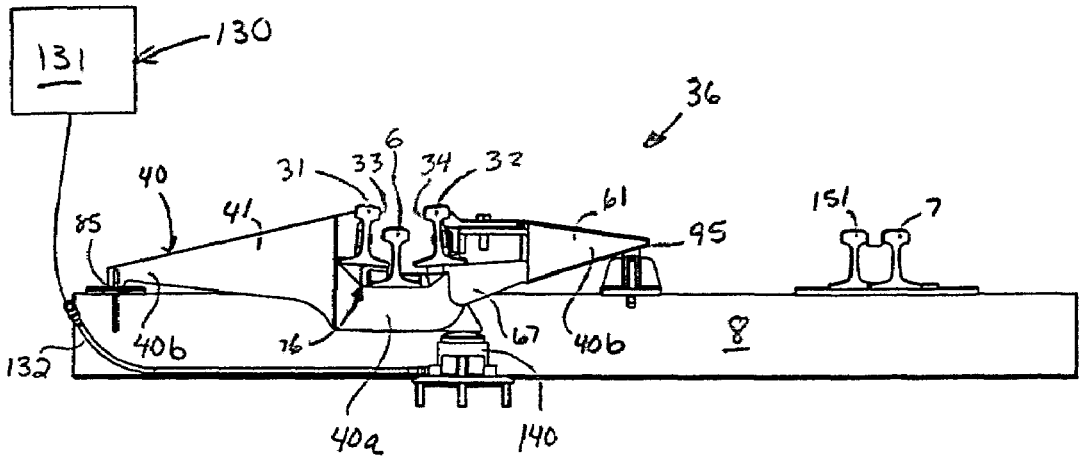
FIG. 4A is a cut away, side end view of the skate retarder lever mechanism in its lower, fail-safe or at-rest operating position.
Figure 4B:
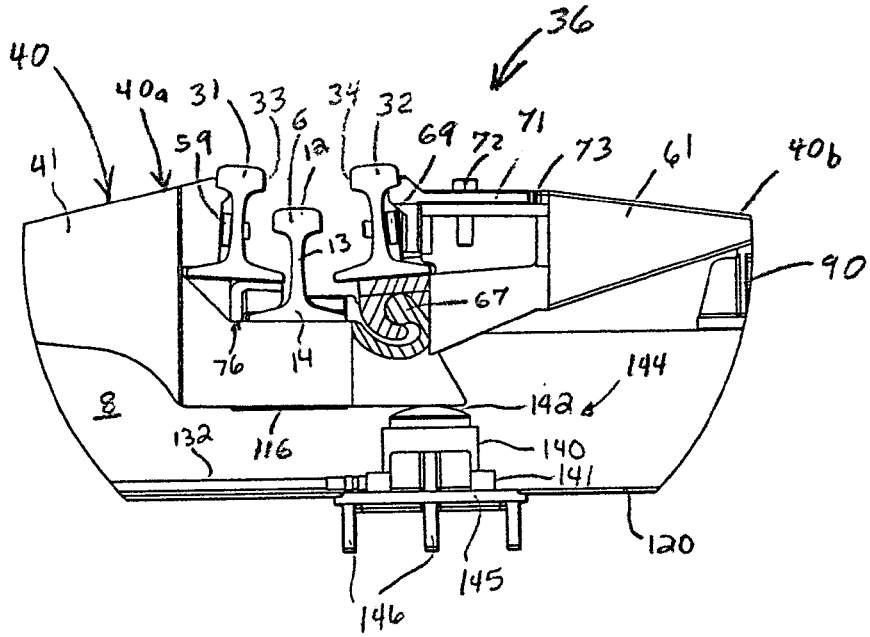
FIG. 4B is a cut away, side end view showing the lever mechanism in its fail-safe position and the hydraulic lift in its lowered or deactivated position, the braking rails are spaced apart a distance less than the width of a conventional railroad car wheel, and a portion of the field lever is cut away to show the knuckle joint joining the levers.
Figure 4C:
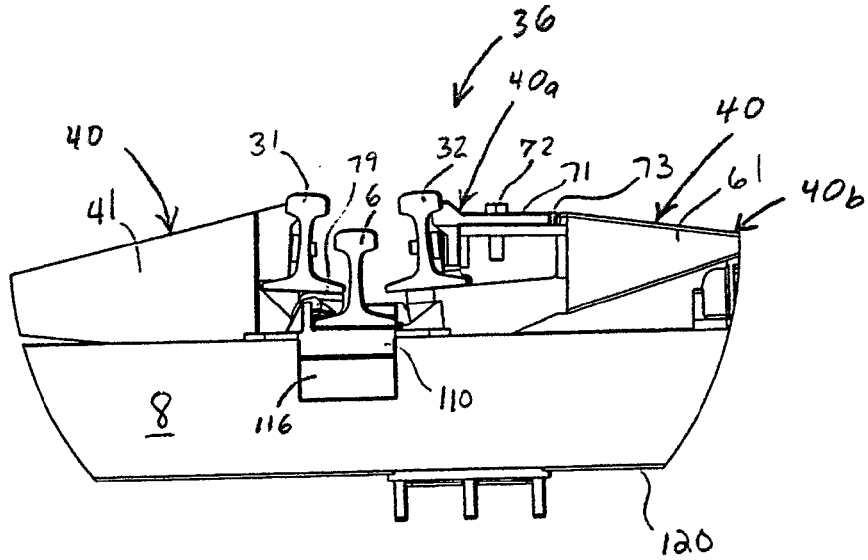
FIG. 4C is a cut away, side end view showing the lever mechanism in its at-rest or fail-safe position, with the tie between the lever assembly and the viewer present to show the running rail resting on the railroad tie saddle.

The retarder 30 is biased by gravity to a lower, fail-safe or operable position 36 shown in FIGS. 4A, 4B and 4C. In its fail-safe or at-rest position 36, the brake rails 31 and 32 are spaced closer together than the width of a conventional car wheel 21. The retarder 30 moves between this lower, fail-safe position 36 and a raised, release or non-operable position 37 shown in FIGS. 5A and 5B. In its raised position 37, the brake rails 31 and 32 are spaced apart further apart than the width of a conventional car wheel 21. When the retarder 30 is in its fail-safe position 36 and the wheels 21 of the railroad car begin to ride over the running rail 6 extending through the retarder 30, the retarder moves to a braking position 38 where a weight-responsive braking force is applied to the sides 27 and 28 of the wheel as shown in FIG. 6. In its braking position 38, the brake rails 31 and 32 are spaced apart the same distance as the width of a conventional car wheel 21, and are in fact forcibly engaging the sides 27 and 28 of the wheel to apply a weight-responsive braking force.

Figure 7A:
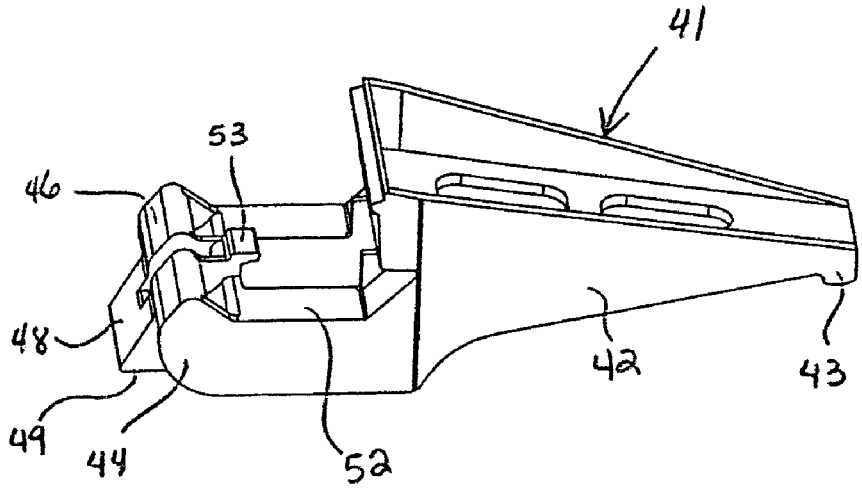
FIG. 7A is a perspective view of the field-side lever.
Figure 7B:
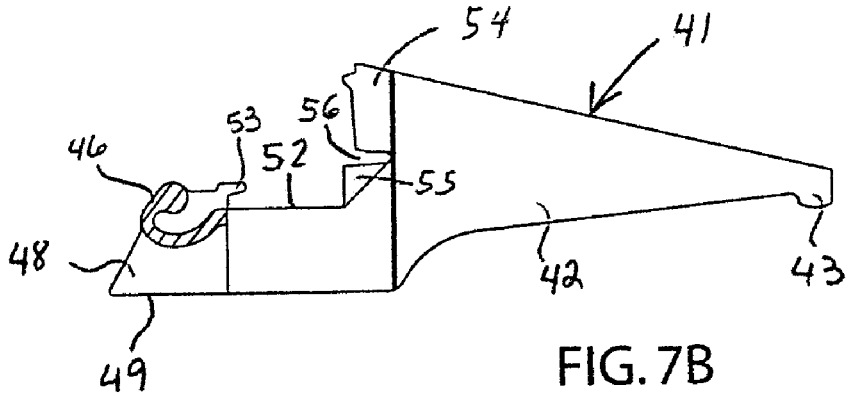
FIG. 7B is a side view of the field-side lever.

Each lever mechanism 40 has a pair of cooperating levers 41 and 61 that are robustly designed to withstand heavy loads and maintain their shape. The field-side lever 41 has a main body or arm 42 with an outer pivot end 43 and an inner rotatable end 44. (FIGS. 7A and 7B). The rotatable end 44 has grooves 46 and includes an extension block 48 that extends beyond the grooves toward the opposing rail 7. The extension block 48 includes a generally flat downwardly facing lower surface 49. The lower surface 49 is heat treated for increased hardness and toughness to withstand repeated cyclical contact with the hydraulic cylinder discussed below. Proximal the rotatable end 44 is a running rail mounting recess 52. The recess 52 is located to the field-side of the grooves 46. A holddown bracket 53 is provided to grip the gauge-side of the base 14 of the running rail 6. The lever 41 includes a brace 54 and bracket 55 on the field-side of the recess 52 that define a brake rail mounting slot 56. The base of the field-side braking rail 31 is inserted into slot 56. The upper brace 54 and lower bracket 55 and slot 56 align the field-side braking rail 31 to the running rail 6. The brace 54, bracket 55 and slot 56 set the vertical, horizontal and angular positioning or offsets of the brake rail 31 relative to the running rail 6. Mounting bolts 59 secure the braking rail 31 to the field-side lever 41.

Figure 8:
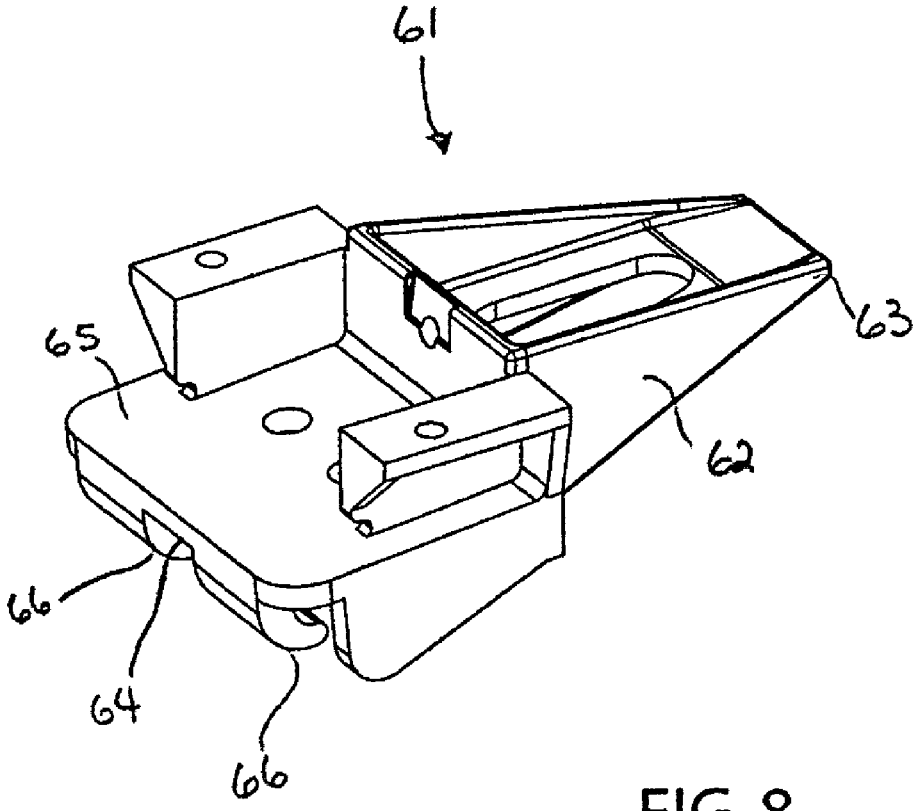
FIG. 8 is a perspective view of the gauge-side lever.

The gauge-side lever 61 has a main body or arm 62 with a pivot end 63 and a rotatable end 64. The rotatable end 64 has a shelf 65 and downwardly projecting fingers 66. (FIG. 8). These fingers 66 are rotatably received by or otherwise mate with the grooves 46 of lever 41 to form a rotatable knuckle joint 67 best shown in FIG. 4B. The knuckle joint 67 is offset to the gauge-side of the running rail 6 a distance of about 6⅝ inches. The base of the gauge-side braking rail 32 rests on the shelf 65 and is bolted 69 or otherwise rigidly secured to the lever 61 via bracket 71. The shelf 65 is at substantially the same height as the slot 56 of lever 41 so that the braking rails 31 and 32 are aligned at substantially the same height relative to each other and above the running rail 6. The field-side lever 41 is longer than the gauge-side lever 61. The field-side lever 41 accounts for about 40% of the length of lever mechanism 40, and the gauge-side lever 61 accounts for about 60% of the length of the lever mechanism.

Figure 9:
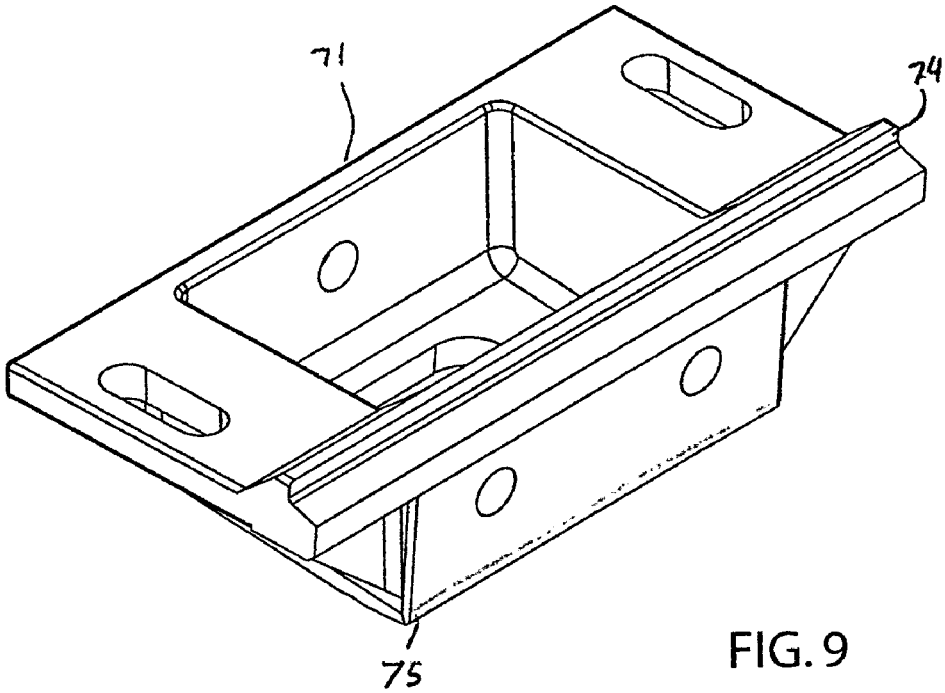
FIG. 9 is a perspective view of the adjustment hub for the gauge-side lever.

The gauge-side lever 61 includes a brake rail adjustment mechanism or hub 71 used to adjust the horizontal spacing between the braking rails 31 and 32. (FIG. 9). The hub 71 fits between and is bolted 72 or otherwise rigidly secured to a pair of opposed shoulders of lever 61. The brake rail 32 is rigidly bolted 69 to the hub 71, which is in turn rigidly bolted 72 to the lever 61. Shims 73 are used to horizontally align the hub 71 and braking rail 32 into their desired horizontal position relative to braking rail 31. The hub 71 has oval or elongated holes for receiving the bolts 72 that secure the hub to the lever 61. The inner face of the hub 71 forms an upper brace 74 and includes a lower slot 75 that matingly receive the head and base of the brake rail 32, respectively. The hub 71, brace 74, and slot 75 set the vertical, horizontal and angular positioning or offsets of the brake rail 32 relative to the running rail 6. The brake rail adjustment hub 71, shims 73 and overall structure of the levers 41 and 61 and their knuckle joint 67 combine to space the braking rails 31 and 32 a desired distance apart when the retarder 30 is in its at-rest, fail-safe position 36. This distance is about 5.06 inches or slightly less than the width of a conventional railroad car wheel 21 as noted above.

Figure 10:
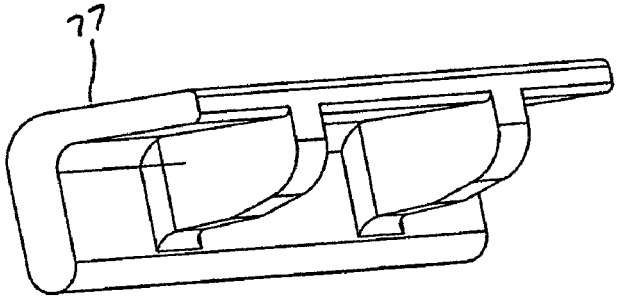
FIG. 10 is a perspective view of the field-side running rail block.
Figure 11:
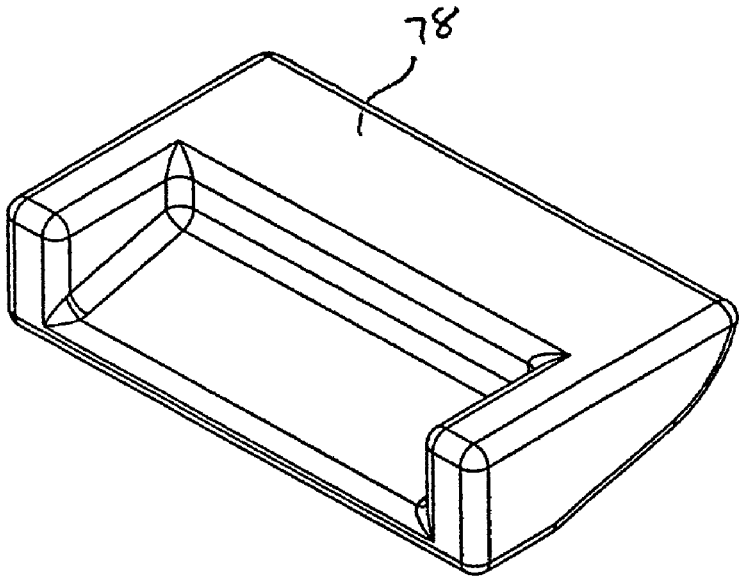
FIG. 11 is a perspective view of the gauge-side running rail block.

The middle portion 40*a* of the lever mechanism 40 is anchored to the running rail 6 by a locking assembly 76 that includes a pair of filler blocks 77 and 78 shown in FIGS. 10 and 11, and a pair of conventional J-clips 79 best shown in FIG. 2. These blocks 77 and 78 are placed in the mounting recess 52 of field-side lever 41. One block 77 or 78 is placed on each side of the running rail 6. The block 77 on the field-side of the running rail 6 is placed over the base 14 of the running rail and beneath the base of the field-side braking rail 31 to hold the running rail 6 in firm engagement with the upper surface of the recess 52 of lever 41. The block 78 on the gauge-side of the running rail 6 is placed over the base 14 of the running rail and is inserted beneath the holddown bracket 53 to further hold the running rail 6 firmly in place against the upper surface of the recess 52 of lever 41. The blocks 77 and 78 horizontally align the running rail 6 in the recess 52 relative to the braking rails 31 and 32. This aligns the lever mechanism 40 and levers 41 and 61 with the running rail 6 so that the brake rails 31 and 32 are horizontally positioned at their desired locations relative to the running rail 6 and railroad car wheels 21. The J-shaped rail clips 79 are rigidly secured to the running rail 6 via a press fit or interference fit. One J-clip 79 is on each side of the lever mechanism 40. Each J-clip 79 is in tight engagement with field-side lever 41 so that the lever moves in unison with the running rail. The J-shaped rail clips 79 keep the lever mechanism 40 and levers 41 and 61 longitudinally aligned at the desired location along the running rail 6 and between adjacent ties 8, particularly with respect to the tie on the downhill side 10.

Figure 12:
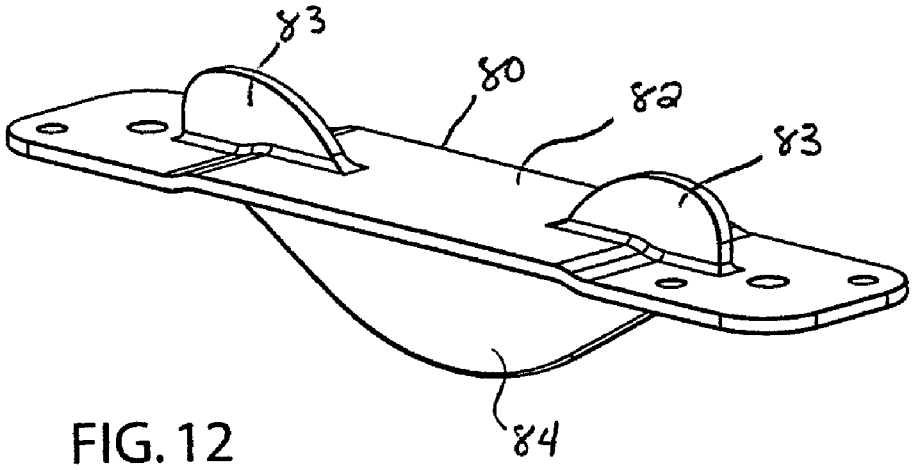
FIG. 12 is a perspective view of the field lever support.

A first lever support 80 is located on the field-side 17 of the running rail 6. The field-side lever support 80 straddles two adjacent railroad ties 8. The support 80 is located towards the field-side 17 end of each tie 8. The lever support 80 includes a plate 82 with stiffening webs 83 and 84 that extend both above and below the plate as shown in FIG. 12. Proximal each end of the plate 82 are downwardly extending anchor bolts that are embedded into the railroad tie 8 to rigidly fix the support 80 to the ties 8. The upper central surface of the plate 82 between its adjacent ties 8 supports the pivot end 43 of field-side lever 41. The lever 41 is not pinned to the support 80, but is free to slide or move both laterally and longitudinally relative to the support 80 and railroad ties 8. This movable engagement between lever 41 and support 80 forms a sliding pivot joint 85.

Figure 13:
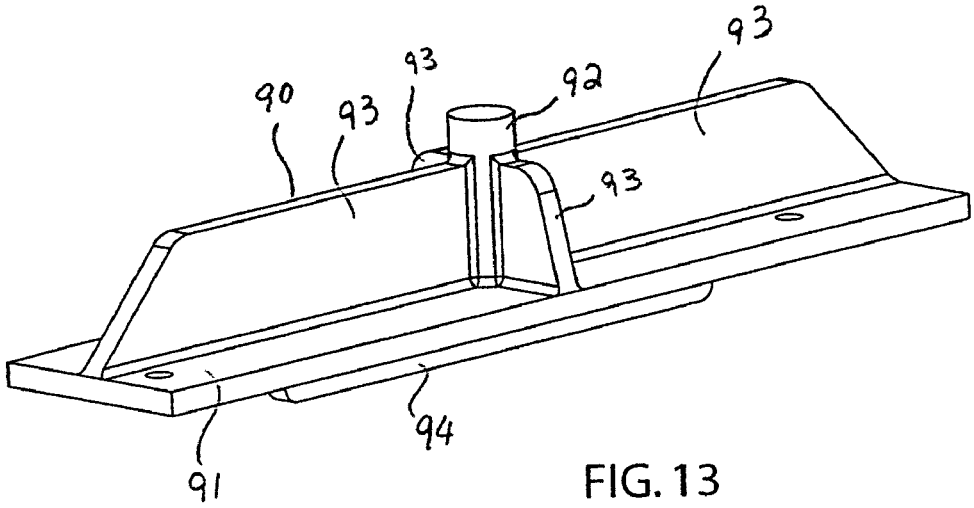
FIG. 13 is a perspective view of the gauge lever support.

A second lever support 90 is located on the gauge-side 18 of running rail 6. The gauge-side lever support 90 is located about half way between the running rails 6 and 7. As with support 80, support 90 is mounted to and extends between two adjacent railroad ties 8. The support 90 includes a plate 91 that extends between the ties 8. As best shown in FIG. 13, the support 90 has a mounting column 92 with a diameter of about three inches extends upwardly from the plate 91 a distance of about 6⅛ inches. The column 92 is centrally located between its adjacent ties 8. Stiffening webs 93 extend longitudinally and laterally from each side of the column 92. A stiffening web 94 also extends below the plate 92. Each end of the plate 92 includes a pair of bolt holes for bolting or otherwise anchoring the support 90 to the ties 8. The upper surface of column 92 supportingly engages the pivot end 63 of lever 61. Lever 61 is not pinned to column 92, but is free to slide or move both laterally and longitudinally relative to the support 90 and railroad ties 8. This movable engagement forms a raised sliding pivot joint 95.

The mounting column 92 places the pivot joint 95 of the gauge-side lever 61 in a permanently raise position as shown in FIGS. 4A through 6. By elevating the pivot joint 95, the retarder 30 and lever mechanism 40 are biased by gravity to the operatable position 36 shown in FIGS. 4A, 4B and 4C. Contrary to conventional Type F-4 retarder design, there is no need to activate a power unit or raising a hydraulic cylinder to move the retarder 30 to an activated or operable position. The mounting column 92 also allows the gauge-side lever 61 to have the same shape and structure as the gauge-side lever of a conventional Type F-4 retarder. The same mold can be used to cast the gauge-side lever 61.

Figure 14:
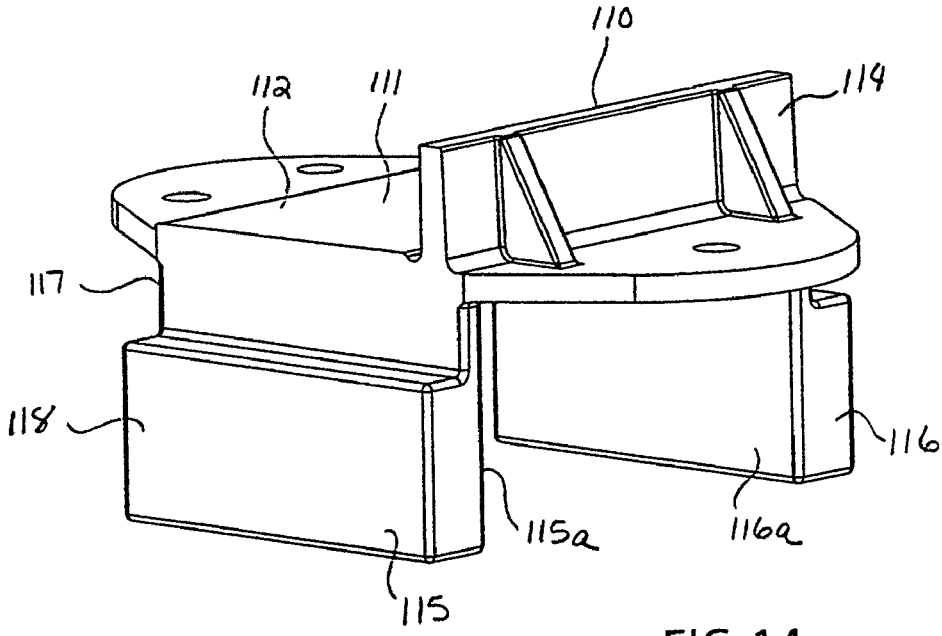
FIG. 14 is a perspective view of the universal saddle with dual side protectors.

The retarder 30 includes a number of universal saddles 110. One saddle 110 is secured to each railroad tie 8 adjacent one of the lever mechanism 40. Each saddle 110 is positioned on its tie 8 directly beneath the running rail 6. As best shown in FIG. 14, each saddle 110 has an upper plate 111 with an upper surface 112 that supportably engages the running rail 6. When the retarder 30 is in its at rest or fail-safe position 36, the running rail 6 is also in an at-rest position with its base 14 resting on the upper surface 112 of the saddles 110 as in FIGS. 4A, 4B and 4C. Each saddle 110 has one upwardly projecting anti-creep flange 114 positioned on the field-side 17 of running rail 6. The flange 114 maintains the running rail 6 a desired lateral distance from the other rail 7 that is rigidly fixed directly to the ties 8 via spikes or a mounting plate. The flange 114 prevents the running rail 6 from creeping to the field-side 17 of the rail due to the loads imparted by the wheels 21 and wheel rims 23 of the railroad cars. The flange 114 has a height of about two inches, which is higher than the maximum movement of the base 14 of the rail 6 when raised to its release position 37. No anti-creep flange is located on gauge-side 18 of the running rail 6 to allow the running rail to freely move up and down responsive to the lever mechanisms 40 without binding, and given that the rims 23 of the wheels 21 are on the gauge-side of the rails 6 and 7.

Each lever mechanism 40 includes two universal saddles 110. One saddle 110 is located on the downhill side 10 of each lever 40, and one saddle 110 is located on the uphill side of each lever. Each universal saddle 110 has a pair of side saddles 115 and 116 that straddle the railroad tie 8 to which it is bolted or otherwise anchored. The side saddles 115 and 116 are like-shaped, each having a thinner neck portion 117 and a thicker body portion 118. Each side saddle 115 and 116 has an inside surface 115*a* or 116*a*. The inside surfaces 115*a* and 116*a* are spaced apart a distance of about 8½ inches, which is slightly greater than the width of a conventional railroad tie 8. The inside surface 115*a* or 116*a* of each side saddle 115 or 116 facing its associated lever mechanism 40 is placed flush against the side of the tie 8. The opposite inside surface 115*a* or 116*a* of each side saddle 115 or 116 is spaced from its associated tie 8.

The universal saddle 110 improves the installation and maintenance flexibility of the retarder 30, which is particularly useful in crowded marshalling yard settings. Because the retarder 30 is anchored to the running rail 6, the brake rails 31 and 32, lever mechanism 40 and running rail 6, tend to skate or move longitudinally in the downhill direction 10 of the track 5 when the retarder 30 absorbs the momentum of a passing railroad car. Thus, the rail 6 and lever mechanism 40 move longitudinally toward the tie 8 and side saddle 115 or 116 on the downhill side 10 of the lever mechanism 40, which is constantly being impacted by the side of field lever 41. The J-clip 79 is received by the thinner neck 117 of the saddle 110, and does not directly engage the saddle. The thick body 118 of the saddle 115 or 116 maintains the lever mechanism 40 and its pivot ends 43 and 63 in their desired longitudinal position relative to the ties 8 and lever supports 80 and 90. The pivot ends 43 and 63 remain appropriately positioned on their lever supports 80 and 90, particularly the pivot end of gauge-side lever 61 remains aligned with mounting column 92. When the retarder 30 has stopped the rail car, the retarder and running rail 6 recoil back a slight amount in the uphill direction and away from the side saddle 115 or 116.

The same retarder assembly 30 and its component parts can be installed on either side of the track 5. Because each universal saddle 110 has two side saddles 115 and 116, the same saddle 110 can be used when the retarder 30 and its brake rails 31 and 32 and lever mechanism 40 are anchored to either running rail 6 or 7 of the track 5. The universal saddle 110 can be placed under either rail 6 or 7 no matter which way the downhill side 10 is heading. There is no need to use or stock both right-handed and left-handed saddles. The marshalling yard can also reduce its inventory of saddles 110 for repair or replacement purposes.

A ballast plate 120 is located beneath the railroad ties 8 along the length of the retarder 30 as best shown in FIGS. 2 and 4. The railroad ties 8 rest on the ballast plates 120, which in turn rest on the ballast gravel. The ballast plates 120 keep the gravel from entering between the railroad ties 8 and into contact with the moving lever mechanisms 40. In particular, gravel is kept clear of the knuckle joint 67, which helps prevent jamming of the lever mechanism 40. The ballast plate 120 also keeps the gravel from interfering with the operation of the devices for pushing the lever mechanisms 40 into their release position 37.

Figure 5A:
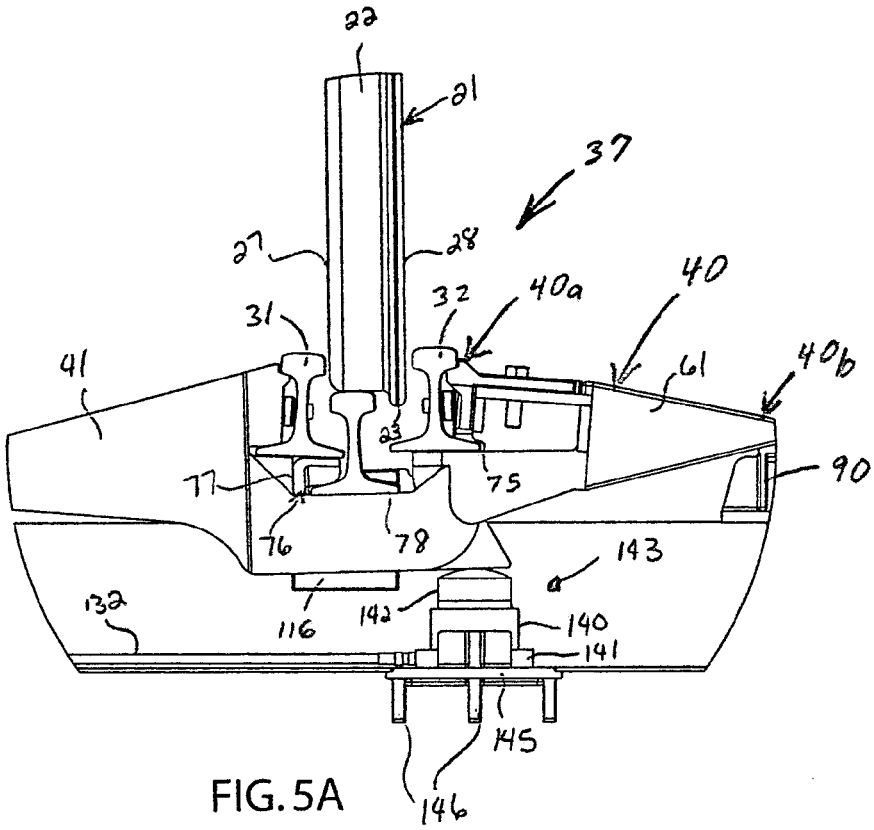
FIG. 5A is a cut away, side end view showing the lever mechanism in its raised or release position and the hydraulic lift in its raised or activated position, and the braking rails are spaced apart a distance greater than the width of a conventional railroad car wheel so that there are gaps between the braking rails and the sides of the wheel.
Figure 5B:
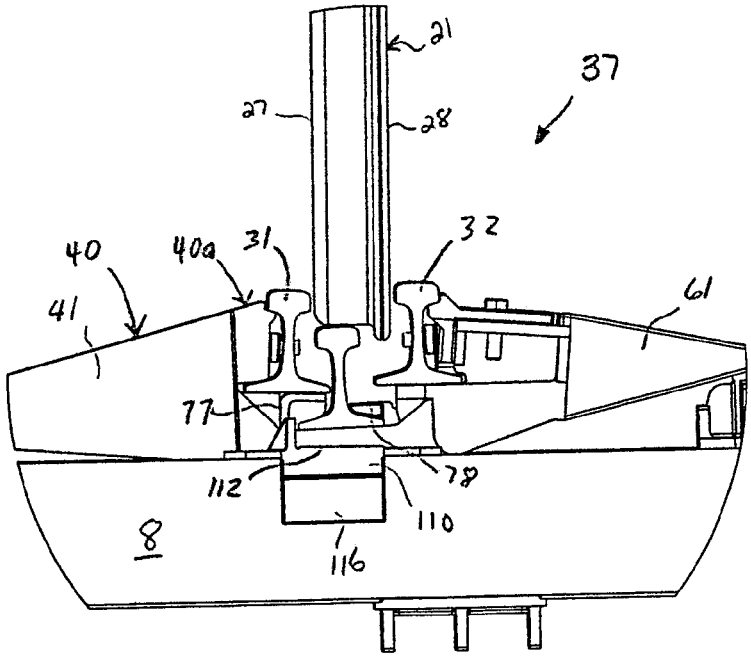
FIG. 5B is a cut away, side end view showing the lever mechanism in its release position with the tie in place to show the running rail raised off the railroad tie saddle.
Figure 6:
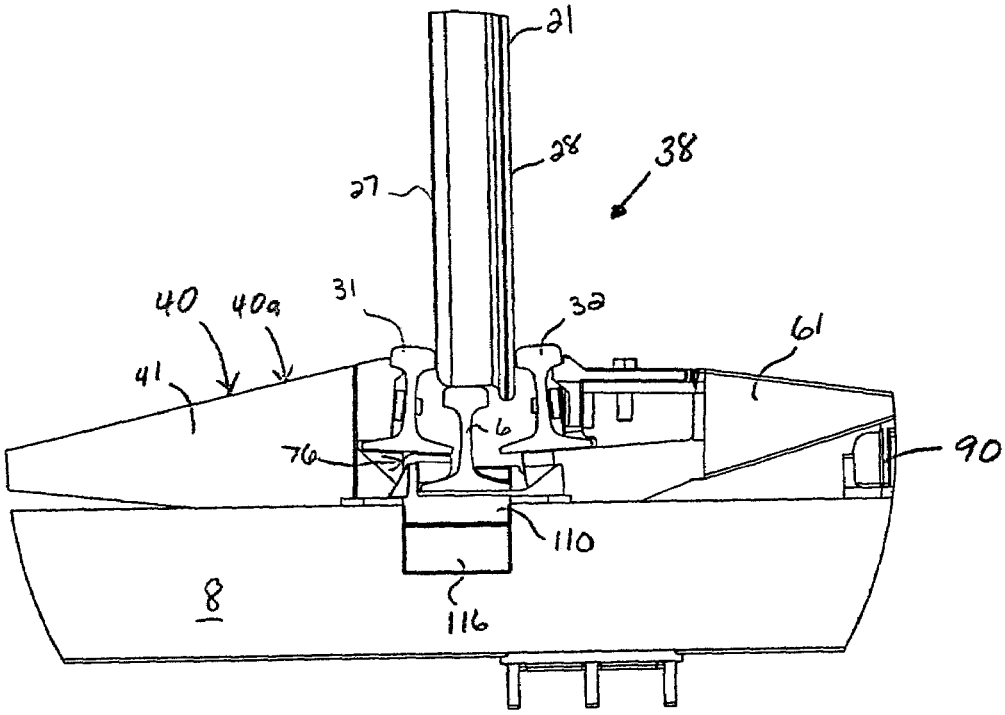
FIG. 6 is a cut away, side end view showing the lever mechanism in its braking position with the running rail elevated from the railroad tie saddle and the braking rails clampingly engaging the side surfaces of the railroad car wheel.

A release mechanism 130 moves the lever mechanism 40 and its levers 41 and 61 to their release position 37 by raising the middle portion 40*a* or inner ends 44 and 64 of the levers 41 and 61 as shown in FIGS. 5A and 5B. The release mechanism 130 includes a conventional hydraulic power unit 131 that supplies pressurized hydraulic fluid via a hose 132 to a conventional hydraulic cylinder 140. The 1.5 Hp power unit 131 pressurizes the fluid up to about 2,000 psi. The hydraulic cylinder 140 produces a force of up to about 40,000 pounds. Although the release mechanism 130 is shown and described as being a hydraulic power unit 131 and cylinder 140, it should be understood that other devices adapted to engage the middle portion 40*a* of the lever mechanism 40, and capable of raising the lever mechanism 40 from its lower at-rest position 36 to its raised release position 37 would be acceptable. In this regard, a hand operated jack, lift or the like could be used to manually lift the lever mechanism 40 should the power unit 131 or hydraulic cylinder 140 malfunction.

The hydraulic cylinder 140 is positioned beneath the running rail 6 and lever mechanism 40. The hydraulic cylinder 140 is not directly beneath the running rail 6, but is laterally offset to the gauge-side 18 of the running rail a distance of about 8½ inches, so that it is directly beneath the extension block 48 of lever 41. The cylinder 140 is positioned to engage the flat lower surface 49 of the block 48. The offset extension block 48 provides a degree of leverage to assist the hydraulic unit 140 raise the weight of a car resting on the retarder 30. The offset also ensures that the pivot end 43 of lever 41 remains engaged with its support 80 when the hydraulic cylinder 140 raises the lever mechanism 40 to its release position 37.

The hydraulic cylinder 140 includes a base 141 and a piston head 142. The piston head 142 is movable between a raised or activated position 143 and a lowered or deactivated position 144. The upper surface of the piston head 142 is rounded so that it engages the flat lower surface 49 of extension 48 at substantially the same contact point at or near the center of the piston head 142 throughout its upward and downward stroke or movement. The center of the knuckle joint 67 is offset or spaced from the contact point between the rounded head 142 and plate 49 a distance of about two (2) inches. The rounded shape of the head 142 ensures that the offset distance remains substantially the same as the cylinder head pushes the flat plate 49 up. The hydraulic cylinder 140 rests on a ballast plate 145 that includes ballast stabilizers 146, which keep the hydraulic cylinder centered beneath extension 48. The stabilizers 146 are uniformly space apart about 4¼ (4.25) inches and have a length of about 24 inches.

The retarder 30 includes an anti-derailing rail 151 located along the gauge-side 18 of the other running rail 7 as shown in FIG. 1. This rail 151 has a length and construction similar to braking rails 31 and 32. Each outer end of the anti-detailing rail 151 is flared or otherwise bowed to accommodate smooth receipt of the wheels 21 of the railroad cars. The anti-derailing rail 151 is fixed parallel to running rail 7 at a continuous spaced distance from the running rail as per conventional retarder design. Similar to the braking rails 31 and 32, the anti-derailing rail 151 also spans the length of the retarder 30.

Operation of the Skate Retarder

Although the above description should adequately describe the operation of the fail-safe, weight-responsive skate retarder 30, the following is provided to further assist the reader in understanding the operation of the device. As indicated above, the skate retarder 30 has a fail-safe, brake-ready position 36, a release position 37 and a braking position 38. In the fail-safe or brake-ready position 36 shown in FIGS. 4A, 4B and 4C, the running rail 6 rests on the upper surface 112 of the universal saddle 110. The hydraulic cylinder 140 is in its lower deactivated position 144. As noted above, the braking rails 31 and 32 are spaced apart a distance of about 5 1/16 (5.06) inches, which is slightly less than the 5 23/32 (5.72) inch width of a railroad car wheel 21. The flared ends of the braking rails 31 and 32 are spaced apart a distance greater than the width of the wheels 21 to ensure smooth receipt of the wheels into the retarder 30.

As the railroad car enters the retarder 30, the side surfaces 27 and 28 of its wheels 21 engage the inside surfaces 33 and 34 of the brake rails 31 and 32, and move the retarder to its braking position 38 shown in FIG. 6. The wheels 21 force or push the brake rails 31 and 32 apart laterally an additional distance of about 2/3 (0.67) inch. Each brake rail 31 and 32 moves laterally a substantial amount or distance to accommodate the wheel 21. In the preferred embodiment, the field-side brake rail 31 moves laterally in a field-side direction a distance of about 9/32 inch, and the gauge side brake rail 32 moves laterally in a gauge side direction a distance of about 13/32 inch. Preferably, one rail 31 or 32 contributes about 25% to 50% of the lateral movement and the other rail 31 or 32 contributes about 50% to 75% of the lateral movement to accommodate the wheel 21.

The lateral movement or spreading of the brake rails 31 and 32 causes levers 41 and 61 to rotate about knuckle joint 67 and pivot about their pivot joints 85 and 95. The middle portion 40*a*, inner ends 44 and 64 and knuckle joint 67 rise along with the running rail 6. The lever mechanism 40 raises the running rail 6 off its adjacent saddles 110 and into braking position 38. The levers 41 and 61 now support the weight of the railroad car, as well as the weight of the running rail 6 and their own weight. Thus, the weight of the car is directly related to the amount of the braking force the brake rails 31 and 32 apply to the side surfaces 27 and 28 of the railroad car wheels 21. The heavier the car, the more braking force applied to the wheels 21.

When yard operations dictate that the retarder 30 be placed in a non-braking condition to allow railroad cars to freely travel through the retarder in an unobstructed manner, the retarder is moved to its release position 37 shown in FIG. 5A. The hydraulic power unit 130 is used to raise the piston head 142 of the hydraulic cylinder 140 to its raised position 143. The hydraulic cylinders 140 press against the lever extensions 48 and raise the middle portions 40*a* of their respective lever mechanisms 40 to their release position 37. Raising the inner ends 44 and 64 and knuckle joint 67 of the levers 41 and 61 causes the brake rails 31 and 32 to spread apart a distance of about six (6) inches, which is slightly more than the width of a railroad car wheel 21 so that there is no braking engagement between the brake rails and the car wheels as the car passes through the retarder 30. Raising the middle 40*a* of the lever mechanism 40 also causes the levers 41 and 61 to pivot about their pivot joints 85 and 95.

When in the release position 37, binding or dragging engagement between the wheel 21 and both brake rails 31 and 32 is prevented or minimized, because each rail moves laterally away from its fail-safe 36 or braking 38 position to the release position. When the retarder 30 moves from its fail-safe position 36 to its release position, the brake rails 31 and 32 move apart a total incremental lateral distance of about one inch, and preferably about 15/16 inch. Each brake rail 31 and 32 moves laterally a sufficient incremental lateral distance to prevent or minimize engagement between both brake rails and the railroad car wheels 21. Given the geometry of the lever mechanism 40 and the lengths of the field-side and gauge-side levers 41 and 61 in the preferred embodiment, each field-side brake rail 31 moves laterally in a field-side direction an incremental lateral distance of about 3/8 inch (about 40% of total movement), and each gauge side brake rail 32 moves laterally in a gauge side direction an incremental lateral distance of about 9/16 inch (about 60% of total movement). Again, one rail 31 or 32 should contribute between about 25% to 50% of the total incremental lateral movement and the other rail 31 or 32 should contribute between about 50% to 75% of the total incremental lateral movement to prevent or minimize engagement of the rails with the wheels 21.

While the invention has been described with reference to a preferred embodiment, it will be understood by those skilled in the art that various changes may be made and equivalents may be substituted without departing from the broad aspects of the invention.

We claim:

1. A fail-safe weight-responsive skate retarder for slowing or stopping a moving rail car having at least one wheel riding on a running rail, the wheel and running rail each having opposed side surfaces, the car having a given weight and its wheel having a predetermined width, said fail-safe weight-responsive skate retarder comprising:

first and second brake rails, one brake rail being aligned along each side of the running rail, said brake rails being substantially parallel to the side surfaces of the running rail and wheel;

a lever mechanism having first and second levers, said first lever holding said first brake rail and said second lever holding said second brake rail, said first and second levers being proximal a middle portion of said lever mechanism, said middle portion extending under and supportably engaging the running rail, said middle portion being movable between a lower fail-safe position, an elevated braking position and a raised non-operable position, said braking rails being spaced closer together than the width of the wheel when in said lower fail-safe position, said braking rails engaging the side surfaces of the wheel when in said elevated braking position, and said braking rails being spaced further apart than the width of the wheel when in said raised non-operable position, said lever mechanism being biased toward said lower fail-safe position;

a release mechanism movable between activated and non-activated positions, said release mechanism forcibly engaging said middle portion of said lever mechanism and selectively moving said lever mechanism to said raised non-operable position when said release mechanism is in said activated position; and, wherein said lever mechanism moves from said lower fail-safe position to said elevated braking position when the wheel of the car enters between and spreads said brake rails apart, said levers raising the running rail and car to said elevated braking position, and said brake rails applying a braking force to the side surfaces of the wheel when in said elevated braking position, said braking force corresponding to the weight of the car, said lever mechanism is located between adjacent ties, and said first and second levers have outer ends, said outer end of said first lever being supported by a first lever support, said outer end of said second lever being supported by a second lever support, and each of said lever supports being mounted to and extending between said adjacent ties.

2. The fail-safe weight-responsive skate retarder of claim 1, and wherein said release mechanism includes a hydraulic cylinder with an expandable chamber and a head, said hydraulic cylinder being selectively operable to move said head between said activated and deactivated positions, said hydraulic cylinder being in said deactivated position when said lever mechanism is in said lower fail-safe position, and said hydraulic cylinder being in said activated position when said lever mechanism is in said raised non-operable position.

3. The fail-safe weight-responsive skate retarder of claim 2, and wherein said first lever includes a block extension, said hydraulic cylinder engaging said block extension, said block extension and hydraulic cylinder being offset from the running rail.

4. The fail-safe weight-responsive skate retarder of claim 1, and wherein said levers are rotatably joined at a joint, said first lever support supports said first lever at a pivot joint, and said second lever support includes a mounting column that supports said second lever at a raised pivot joint.

5. The fail-safe weight-responsive skate retarder of claim 1, and wherein said retarder includes a universal saddle secured to each of said adjacent ties, each universal saddle having a pair of side saddles and an anti-creep flange, one side saddle being on each side of the tie.

6. The fail-safe weight-responsive skate retarder of claim 5, and wherein said lever mechanism has a rail mount, the running rail being anchored to said rail mount by a locking assembly, and said pivot joints being sliding pivot joints, and each of said levers is rigidly joined to its said brake rail.

7. The fail-safe weight-responsive skate retarder of claim 6, and wherein the rail car is a railroad car and the ties are railroad ties.

8. The fail-safe weight-responsive skate retarder of claim 1, and wherein each brake rail moves laterally a sufficient incremental lateral distance when said retarder moves from said fail-safe position to said release position to minimize engagement between both said brake rails and the wheel.

9. The fail-safe weight-responsive skate retarder of claim 8, and wherein said brake rails combine to move a total incremental lateral distance when moving between said fail-safe position to said release position, and one of said brake rails contributing about 25% to 50% of said total incremental lateral distance and said other brake rail contributing about 50% to 75% of said total incremental lateral distance.

10. The fail-safe weight-responsive skate retarder of claim 9, and wherein a gauge-side brake rail contributes about 60% of said total incremental lateral distance and a field-side brake rail contributes about 40% of said total incremental lateral distance.

11. A weight-responsive skate retarder for stopping a moving railroad car with wheels that ride on a railroad track having first and second uniformly spaced running rails mounted on a plurality of ties, the track having a downhill side, the wheels and running rails each having opposed side surfaces, the car having a given weight and its wheels having a predetermined width, said weight-responsive skate retarder comprising:

first and second brake rails, one brake rail being aligned along each side of the running rail, said brake rails being substantially parallel to the side surfaces of the running rail and wheel;

a lever mechanism positioned between adjacent ties and having first and second levers, said first lever holding said first brake rail and said second lever holding said second brake rail, said first and second levers being rotatably joined at a joint proximal a middle portion of said lever mechanism, said middle portion extending under and having a rail mount that supportably engages a selected running rail of either the first and second running rails, said middle portion being movable between an operable position, an elevated braking position and a non-operable position, said braking rails being spaced closer together than the width of the wheel when in said operable position, said braking rails engaging the side surfaces of the wheel when in said elevated braking position, and said braking rails being spaced further apart than the width of the wheel when in said non-operable position;

a universal saddle secured to each of said adjacent ties, each universal saddle having a pair of side saddles and an anti-creep flange placed on a field-side of the selected running rail, one side saddle being on each side of the tie;

a release mechanism movable between activated and non-activated positions, said release mechanism forcibly engaging said lever mechanism and selectively moving said lever mechanism to one of either said operable position and said non-operable position when said release mechanism is in said activated position; and, wherein said lever mechanism moves from said operable position to said elevated braking position when the wheel of the car enters between and spreads said brake rails apart, said levers rotating about their said joint to raise said rail mount and the selected running rail and car to said elevated braking position, said brake rails applying a braking force to the side surfaces of the wheel when in said elevated braking position, and said braking force corresponding to the weight of the car.

12. The weight-responsive skate retarder of claim 11, and wherein said lever mechanism is located between adjacent ties, and said first and second levers have outer ends, said outer end of said first lever being supported by a first lever support, said outer end of said second lever being supported by a second lever support, and each of said lever supports being mounted to and extending between said adjacent ties.

13. The weight-responsive skate retarder of claim 12, and wherein said lever mechanism is anchored to the running rail by a locking assembly, said pivot joints are sliding pivot joints, and each of said levers is rigidly joined to its said brake rail.

14. The weight-responsive skate retarder of claim 11, and wherein the tie has a predetermined width, said side saddles have inside surfaces, and said inside surfaces are spaced apart a distance greater than the width of the tie.

15. The weight-responsive skate retarder of claim 14, and wherein said inside surfaces of said side saddles are spaced apart at least about 8½ inches.

* * * * *